US005438156A

United States Patent [19]

Masuda et al.

[11] Patent Number: 5,438,156

[45] Date of Patent: Aug. 1, 1995

[54] WIND TYPE TONE SYNTHESIZER ADAPTED FOR SIMULATING A CONICAL RESONANCE TUBE

[75] Inventors: Hideyuki Masuda; Toshifumi Kunimoto, both of Hamamatsu, Japan

[73] Assignee: Yamaha Corporation, Japan

[21] Appl. No.: 878,778

[22] Filed: May 5, 1992

[30] Foreign Application Priority Data

May 9, 1991 [JP] Japan ..... 3-104501

[51] Int. Cl.[6] ..... G10H 5/02

[52] U.S. Cl. ..... 84/659; 84/661

[58] Field of Search ..... 84/622, 630, 659, 661

[56] References Cited

U.S. PATENT DOCUMENTS

| | | | |
|---|---|---|---|
| 4,475,229 | 10/1984 | Frese | 84/DIG. 26 X |
| 4,736,333 | 4/1988 | Mead et al. | 84/630 X |
| 4,984,276 | 1/1991 | Smith | 84/630 X |
| 5,113,743 | 5/1992 | Higashi | 84/622 |
| 5,117,729 | 6/1992 | Kunimoto | 84/660 |
| 5,131,310 | 7/1992 | Kunimoto | 84/604 |
| 5,136,917 | 8/1992 | Kunimoto | 84/624 |
| 5,144,096 | 9/1992 | Kunimoto | 84/659 |
| 5,157,214 | 10/1992 | Nakanishi et al. | 84/622 |
| 5,157,218 | 10/1992 | Kunimoto et al. | 84/659 |
| 5,182,415 | 1/1993 | Kunimoto | 84/660 |
| 5,187,313 | 2/1993 | Inoue | 84/622 |
| 5,187,314 | 2/1993 | Kunimoto et al. | 84/626 |
| 5,245,127 | 9/1993 | Yamauchi et al. | 84/624 |
| 5,248,844 | 9/1993 | Kunimoto | 84/622 |
| 5,252,776 | 10/1993 | Mutoh | 84/659 |
| 5,256,830 | 10/1993 | Takeuchi et al. | 84/625 |
| 5,276,272 | 1/1994 | Masuda | 81/600 |
| 5,298,678 | 3/1994 | Higashi | 84/659 |

FOREIGN PATENT DOCUMENTS

| | | |
|---|---|---|
| 393701A2 | 4/1990 | European Pat. Off. . |
| 393703A2 | 4/1990 | European Pat. Off. . |
| 397149A2 | 5/1990 | European Pat. Off. . |
| 0393701 | 10/1990 | European Pat. Off. . |
| 0393703 | 10/1990 | European Pat. Off. . |
| 0397149 | 11/1990 | European Pat. Off. . |

OTHER PUBLICATIONS

Chafe, Chris, "Pulsed Noise in Self-Sustained Oscillations of Musical Instruments", *IEEE* (1990), pp. 1157–1160.

*Primary Examiner*—William M. Shoop, Jr.
*Assistant Examiner*—Jeffrey W. Donels
*Attorney, Agent, or Firm*—Graham & James

[57] ABSTRACT

An acoustic wind instrument having a conical tube is simulated by two cylindrical tubes communicated to each other at each one end. A parallel connection of electrical signal transmission lines, each simulating a cylindrical tube constitute a synthesizer synthesizing the sound of the conical acoustic wind instrument. Each signal transmission line includes a shift register for giving a delay to the input signal, a multiplier for simulating sound reflection, and a filter for affording a tone color. An exciting signal is injected at the interconnection of the parallel connection through a junction circuit.

19 Claims, 8 Drawing Sheets

WIND TYPE TONE SYNTHESIZER ADAPTED FOR SIMULATING A CONICAL RESONANCE TUBE

BACKGROUND OF THE INVENTION a) Field of the Invention

The present invention relates to a tone synthesizer for synthesizing a tone of an acoustic musical instrument.

b) Description of the Related Art

Such a tone synthesizer is known which electrically simulates a mechanism for generating a musical tone in an acoustic musical instrument. A tone synthesizer adapted for synthesizing a musical tone of a wind instrument, for example, comprises an exciting circuit for generating a driving waveform signal corresponding to pressure change in a mouthpiece, and a resonance circuit simulating characteristics of a resonance tube which responds to pressure change in the mouthpiece of the wind instrument. A cylindrical resonance tube can be simulated by a transmission circuit called a waveguide usually constituted by a loop circuit which comprises a delay circuit and a filter. The transmission circuit receives a driving waveform signal from an exciting circuit and outputs a signal of a certain frequency range after amplifying the signal and repeatedly circulating the signal in the loop of the transmission circuit.

A wind instrument such as a saxophone or a trumpet has a conical resonance tube, which in general is considered equivalent to a number of cylindrical short resonance tubes having different diameters and connected in series in the order of the magnitude of the diameter. Consequently, a conical tube is usually simulated by a resonance circuit comprising a plurality of wave-guides and junctions cascading the wave-guides one by one. A tone synthesizer having such a resonant circuit is disclosed, for example, in Japanese Patent Publication Laid-open Nos. Sho-63-40199 and Hei-3-235997.

In order to faithfully simulate a transfer function of a conical resonance tube by a resonance circuit described above, it is necessary to connect many stages of the combination of a waveguide and a junction. Generally, a junction comprises a multiplier for multiplying the input, which is usually large in size. Thus, a conventional resonance circuit comprising a number of Junctions for simulating a wind acoustic instrument with a conical resonance tube is usually large in size.

In order to maintain a similar tone color at different tone pitches, it is necessary to keep the shape of a flared or conical tube in similar shapes. For simulating such similar shapes, it is necessary to control the coefficients of junctions representing cylindrical resonance tubes of different diameter in connection with the tone pitch (delay length). Thus, the control becomes complicated and the circuit scale becomes larger.

In order to simulate a conical resonance tube by a digital signal processor (DSP) executing a certain program in place of an electronic circuit comprising a number of transmission circuits as described above, the amount of processing per unit time the DSP should handle becomes large. It is, therefore, necessary to employ a high speed DSP. Hence, the cost of the DSP increases.

SUMMARY OF THE INVENTION

An object of the invention is to provide a tone synthesizer comprising an electronic circuit of a relatively compact size and adapted for simulating an acoustic musical instrument having a diverging resonance tube.

Another object of this invention is to provide a tone synthesizer which simulates tone generating mechanism of a wind instrument by substituting a conical tube with a pair of cylindrical tubes, thereby avoiding the necessity of controlling the coefficients of junctions in connection with the tone pitch for controlling the tone color, and enabling stable tone color control with little tone color variation only by control of the delay length, i.e. tone pitch.

Another object of the invention is to provide a tone synthesizer comprising at least one DSP in which the amount of processing per unit time to be executed is relatively small.

BRIEF DESCRIPTION OF THE DRAWINGS

These and other object of the invention will be more apparent from the following description, referring to the accompanying drawings in which.

DESCRIPTION OF THE PREFERRED EMBODIMENTS

Figure 1:
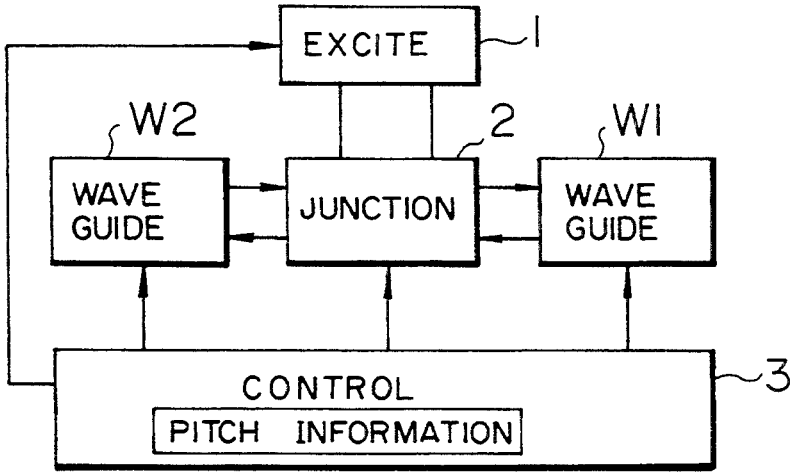
FIG. 1 is a block diagram showing a configuration of a tone synthesizer according to an embodiment of the invention.

FIG. 1 is a block diagram showing a basic configuration of a tone synthesizer according to an embodiment of the invention. In FIG. 1, the tone synthesizer comprises an exciting circuit 1 for simulating a mouthpiece of a wind acoustic instrument, a junction 2, a first and a second waveguide W1 and W2 adapted for simulating characteristics of a resonance tube fed with the output signal of the exciting circuit 1 through the junction 2 and connected in parallel to each other by the junction 2, and a control circuit 3 for controlling the parameters of the exciting circuit 1, the junction 2 and the waveguides W1 and W2. The control circuit 3 includes a pitch information supply which controls the resonance pitch of at least one of the waveguides W1 and W2 in response to a tone pitch designated by a player, for example, in a keyboard.

The wave-guides W1 and W2 are coupled with each other to simulate an input acoustic impedance of a conical resonance tube, each simulating an impedance obtained by analytically decomposing the acoustic impedance of an acoustic resonance tube.

To help understanding of the invention, analytic decomposition of an acoustic wind instrument will be described first.

Figure 2:
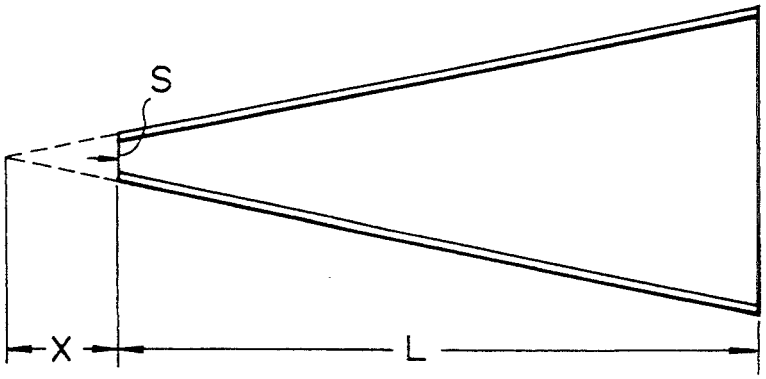
FIG. 2 is a longitudinal sectional view of a conical tube to be simulated.

The input acoustic impedance Z of a conical tube of a wind acoustic instrument depicted in FIG. 2 can be expressed by the following equation.

$$Z = j \cdot \rho \cdot c \cdot k \cdot X \cdot \sin(k \cdot L)/\{S(\sin(k \cdot L) + k \cdot X \cdot \cos(k \cdot L)\} = 1/\{S/(j \cdot \rho \cdot c \cdot k \cdot X) + S/(j \cdot \rho \cdot c \cdot \tan(k \cdot L)\} \quad (1)$$

wherein the symbols $\rho$, c, X, L, and S represent density of the medium (g/cm$^3$), velocity of sound(cm/sec), length of the throat of the conical tube (cm), the length of the conical tube (cm) and cross-sectional area of the conical tube at the location of the minimum diameter, respectively. Symbol k represents wave number (rad/cm) and is expressed as $k=2\pi/\lambda$, wherein $\lambda$ is the wave-length of sound.

The first and the second terms appearing in the dedominator in equation (1) are rewritten as, $$Zx = j \cdot \rho \cdot c \cdot k \cdot X/S = j \cdot \omega \cdot \rho \cdot S \cdot X/S^2 = j \cdot \omega \cdot m/S^2 = j \cdot \omega \cdot M \quad (2)$$

$$Z_L = (j \cdot \rho \cdot c \cdot \tan(k \cdot L))/S \quad (3)$$

wherein $\omega$ represents angular frequency (rad/sec) of sound and is expressed as $\omega=c \cdot k$. Then the following equation is obtained:

$$1/Z=1/Z_X+1/Z_L \quad (4)$$

From above equation (4), it is understood that the input acoustic impedance Z of a conical tube is equivalent to the impedances $Z_X$ and $Z_L$ connected in parallel to each other. The impedance $Z_X$ can be simulated by an inertance M expressed as $M=\rho \cdot X/S$(g/cm4). Because an input impedance Zi at the transmission end of a transmission line having loss-less parallel lines, when short-circuited at the receiving end, is expressed as $Zi=j \cdot \tan(k \cdot L)$, the impedance $Z_Z$ can be simulated by an input acoustic impedance of a cylindrical tube having a constant diameter and an open end. Consequently, it is concluded that the conical resonance tube depicted in FIG. 2 is equivalent to a cylindrical resonance tube in FIG. 3, of which one end is open and the other end is connected to an inertance member with inertance M, the resonance tube having a cross-sectional area S and a length L. The breath of a performer is injected into the junction as indicated by an arrow P between the inertance member M and the cylindrical tube.

When a conical tube, i.e. the so-called bugle, is substituted by a pair of cylindrical tubes, the control of the tone pitch can be made simply through the control of delay amount, i.e. the amount of delay corresponding to the tube length L.

In a former proposal by the present assignee (JP-A 3-235997), a multiplicity of junction coefficients and delay lengths should be controlled in mutually interrelated manner for suppressing the tone color change upon change of the tone pitch.

If the length of the throat X of the conical tube in FIG. 2 is short enough, then the impedance $Z_X$ in equation (4) can be approximated with the following equation, $$Z_X \simeq (j \cdot \rho \cdot c \cdot \tan(k \cdot X))/S \quad (5)$$

Figure 3:
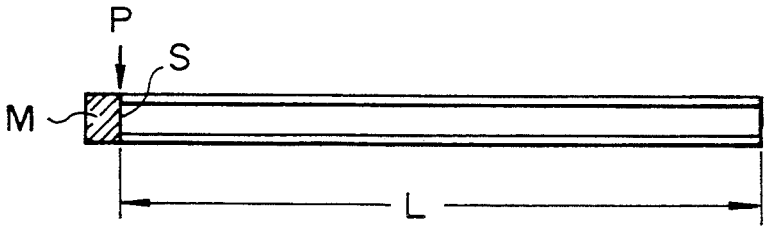
FIG. 3 is a longitudinal sectional view of a cylindrical tube model equivalent to the conical tube of FIG. 2.
Figure 4:
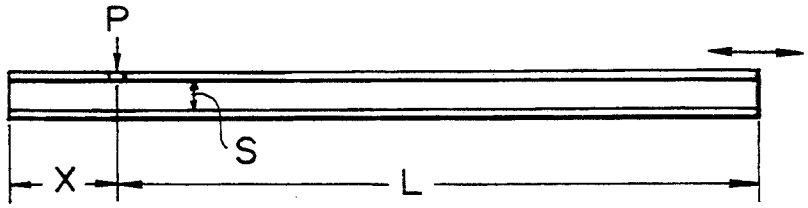
FIG. 4 is a longitudinal sectional view of another cylindrical tube model equivalent to the conical tube of FIG. 2.

The impedance $Z_X$ can be also simulated, from the equation (5), by an input acoustic impedance of a cylindrical resonance tube with a cross-sectional area S and a length L. Consequently, the conical tube in FIG. 2 is equivalent to the resonance tube model shown in FIG. 4 by applying the approximation of equation (5) to the throat portion. As shown in FIG. 4, the inertance member M of the resonance tube in FIG. 3 is replaced by a cylindrical tube with a length X by the approximation by equation (5).

The acoustic instrument with a conical tube shown in FIG. 2 is equivalent to a wind instrument comprising two cylindrical tubes each of which has a cross-sectional area S and lengths X and L respectively. Therefore, a conclusion is obtained that the acoustic instrument with a conical tube is simulated by a tone synthesizer which simulates the wind instrument shown in FIG. 4. In case of the resonance tube model of FIG. 4, the breath of a performer is injected into the junction between a cylindrical tube with a length L and a cylindrical tube with a length X, as indicated by an arrow P.

The synthesizer shown in FIG. 1 is adapted to simulate the resonance tube model in FIG. 4 and a resonance tube model shown in FIG. 5 which will be described later. The waveguides W1 and w2 of FIG. 1 correspond to cylindrical tubes with a length L and a length X, as shown in FIG. 4. In case of the resonance tube model in FIG. 4, the resonance frequency can be changed by changing the length L. Consequently, also in case of the synthesizer in FIG. 1, which simulates the resonance tube model in FIG. 4, the tone pitch can be changed continuously by controlling the parameters of a waveguide or waveguides. Specifically, the delay length of the waveguide W1, which corresponds to a cylindrical tube of length L, may be varied in correspondence to the length L or the desired tone pitch.

When the length X of the throat of the conical tube is considerably long so that the approximation with the above equation (5) is not accurate, the following approximation can be applied. The cross-sectional area S and the length X in equation (2) are substituted by parameters S1 and X1 which satisfy X/X1=S/S1 and kX<k1. By this substitution, the following equation is obtained:

$$Z_X = j\cdot\rho\cdot c\cdot k\cdot X/S = j\cdot\rho\cdot c\cdot k\cdot X1/S1 \quad (6)$$

Since k·x1 is smaller than 1 in equation (6), the equation (6) can be approximated by the following equation, $$Z_X \approx (j\cdot\rho\cdot c\cdot \tan(k\cdot X1))/S1 \quad (7)$$

Figure 5:
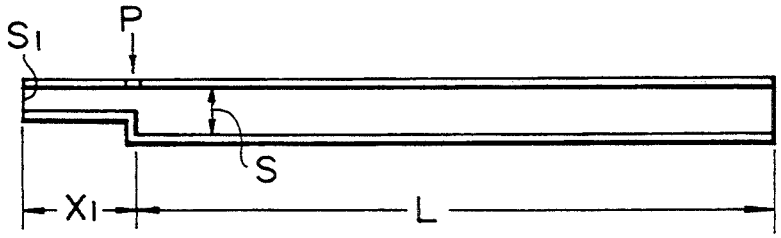
FIG. 5 is a longitudinal sectional view of still another cylindrical tube model equivalent to the conical tube of FIG. 2.

FIG. 5 shows the structure of a resonance tube model as obtained by approximation according to equation (7). The cylindrical tube with a cross-sectional area S and a length X as shown in FIG. 4 can be approximated by a cylindrical tube with a cross-sectional area S1 and a length X1 in FIG. 5, according to the approximation of impedance $Z_X$. In order to obtain an accurate approximation according to the equation (7), it is desirable to select k·X1 as small as possible. Consequently, in order to faithfully generate similar musical sounds as generated by such a conical resonance tube as shown in FIG. 2, it is desirable to select the length X1 of the resonance tube model shown in FIG. 5 as short as possible. For realizing this condition, the time required for one circulation of the signal in the wave-guide, i.e. the delay time corresponding to the length X1, is selected as short as possible. When the waveguide is implemented by a digital circuit, for example, the number of cascaded stages in a delay element constituted by, for example, a shift register inserted in the waveguide is preferably selected as 1. As a result, total delay time can be reduced so that the synthesizer can generate accurate musical sounds as generated by an acoustic instrument with a conical tube.

Figure 6:
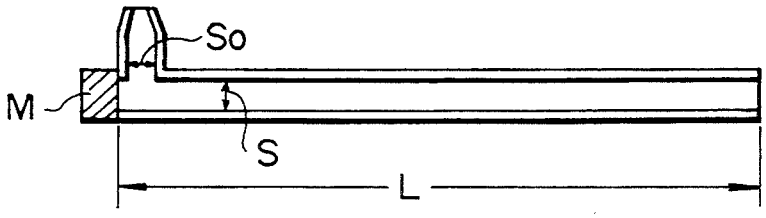
FIG. 6 is a longitudinal sectional view of a wind instrument model in which the model of FIG. 3 is further provided with a mouthpiece.
Figure 7:
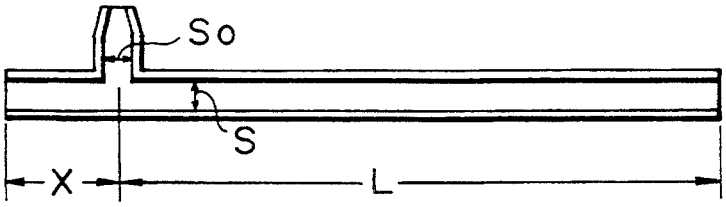
FIG. 7 is a longitudinal sectional view of a wind instrument model in which the model of FIG. 4 is further provided with a mouthpiece.
Figure 8:
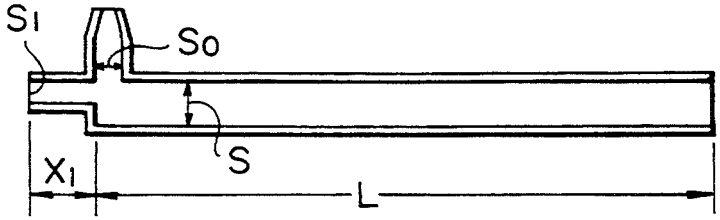
FIG. 8 is a longitudinal sectional view of a wind instrument model in which the model of FIG. 5 is further provided with a mouthpiece.

FIGS. 6 to 8 each shows an acoustic wind instrument according to an embodiment of the invention. Each wind instrument corresponds to a corresponding resonance tube model shown in FIGS. 3 to 5, respectively. These acoustic wind instruments can more closely simulate acoustic wind instruments, due to the provision of a mouthpiece with a cross-sectional area So at the junction between a cylindrical tube and an inertance member or between two cylindrical tubes.

Figure 9:
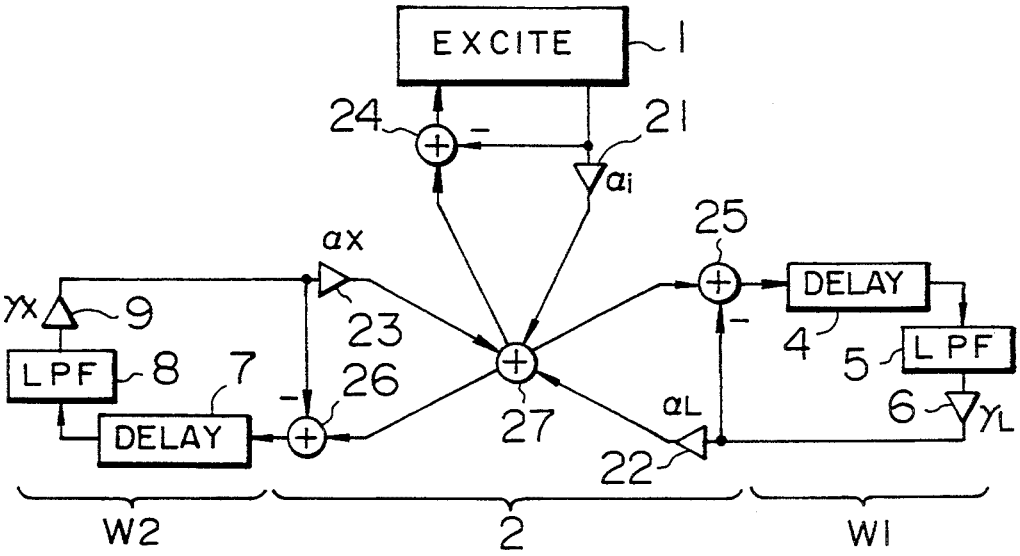
FIG. 9 is a block diagram showing a configuration of a tone synthesizer according to an embodiment of the invention.

A block diagram of a tone synthesizer for simulating wind instruments as depicted in FIGS. 7 and 8 is shown in FIG. 9, which is a more detailed block diagram of a tone synthesizer than that of FIG. 1. The value of a parameter or parameters of each component in the circuit is determined depending on a wind instrument model to be simulated.

The waveguide W1, corresponding to the first cylindrical tube with a length L in FIGS. 7 and 8, comprises a delay circuit 4 for simulating a time required for a sound signal to reciprocate in the wind instrument, a low-pass filter 5 for simulating acoustic loss in the cylindrical tube, and a multiplier 6 with multiplication factor $\gamma_L$ for simulating sound reflection at the tube end. The delay circuit 4 is constituted by a shift register having a number of the stages equal to Fs2L/c and driven by a clock signal with a constant angular frequency Fs.

The waveguide W2 corresponding to the second cylindrical tube with a length X in FIG. 7 or a length X1 in FIG. 8 comprises, as in the case of the first waveguide W1, a delay circuit 7, a low-pass filter 8, and a multiplier 6 with a multiplication factor $\gamma_X$. The number of the cascaded stages of a shift register constituting the delay circuit 7 is equal to Fs2X/c or Fs2X1/c, corresponding to the second cylindrical tube in FIG. 7 or FIG. 8, respectively. In case of the latter, however, the number is more preferably selected at 1.

The junction 2 is inserted between the exciting circuit 1 and the waveguides W1 and W2, and comprises output multiplier 21, 22 and 23 each of which multiplies the signal transmitted from the exciting circuit 1, waveguides W1 and W2 with multiplication factors $\alpha_i$, $\alpha_L$ and $\alpha_X$, respectively.

In case of the tone synthesizer simulating the wind instrument model in FIG. 7, the multiplication factors $\alpha_i$, $\alpha_L$ and $\alpha_X$ of FIG. 9 are determined as, $$\alpha_i = 2So/(So+2S) \quad (8)$$

$$\alpha_L = 2S/(So+2S) \quad (9)$$

and $$\alpha_X = \alpha_L \quad (10)$$

In case of the tone synthesizer simulating the wind instrument model in FIG. 8, the multiplication factors $\alpha_i$, $\alpha_L$ and $\alpha_X$ are determined as, $$\alpha_i = 2So/(So+S+S1) = 2So/(So+S+(X1/X)S) \quad (11)$$

$$\alpha_L = 2S/(So+S+(X1/X)S) \quad (12)$$

$$\alpha_L = 2(X1/X)S/(So+S+(X1/X)S) \quad (13)$$

Figure 10:
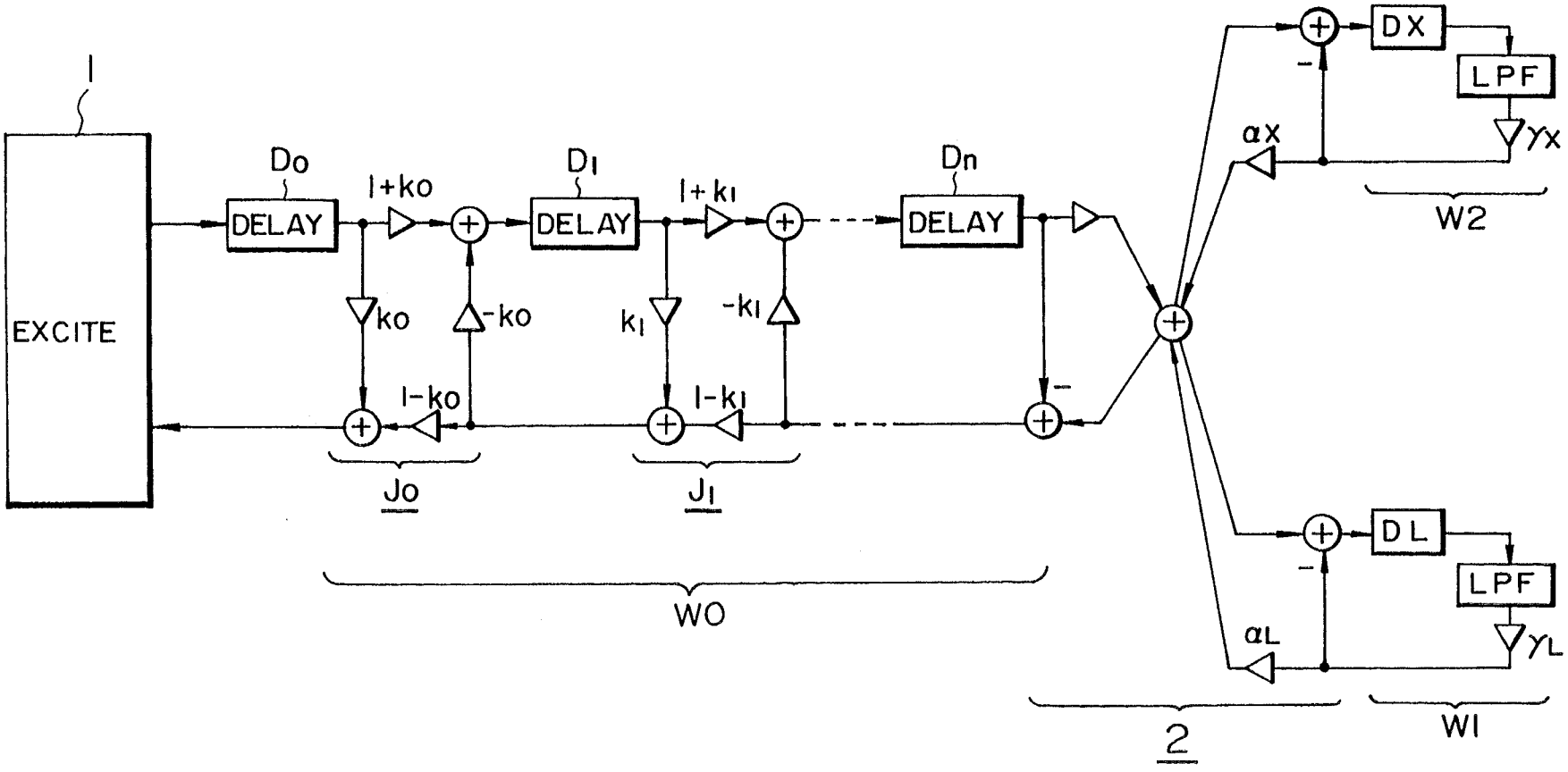
FIG. 10 is block diagram showing another embodiment in which a propagation delay of air pressure wave in a mouthpiece is taken into account.

In order to accurately simulate pressure change propagation caused by air vibration in the mouthpiece in FIGS. 7 and 8, there is preferably provided a tone synthesizer comprising a third waveguide W0 as shown in the block diagram of FIG. 10. The third waveguide W0 is inserted between the exciting circuit 1 and the junction 2, and comprises a plurality of combinations, each including a delay circuit and a 4-multiplication-lattice junction.

Figure 11:
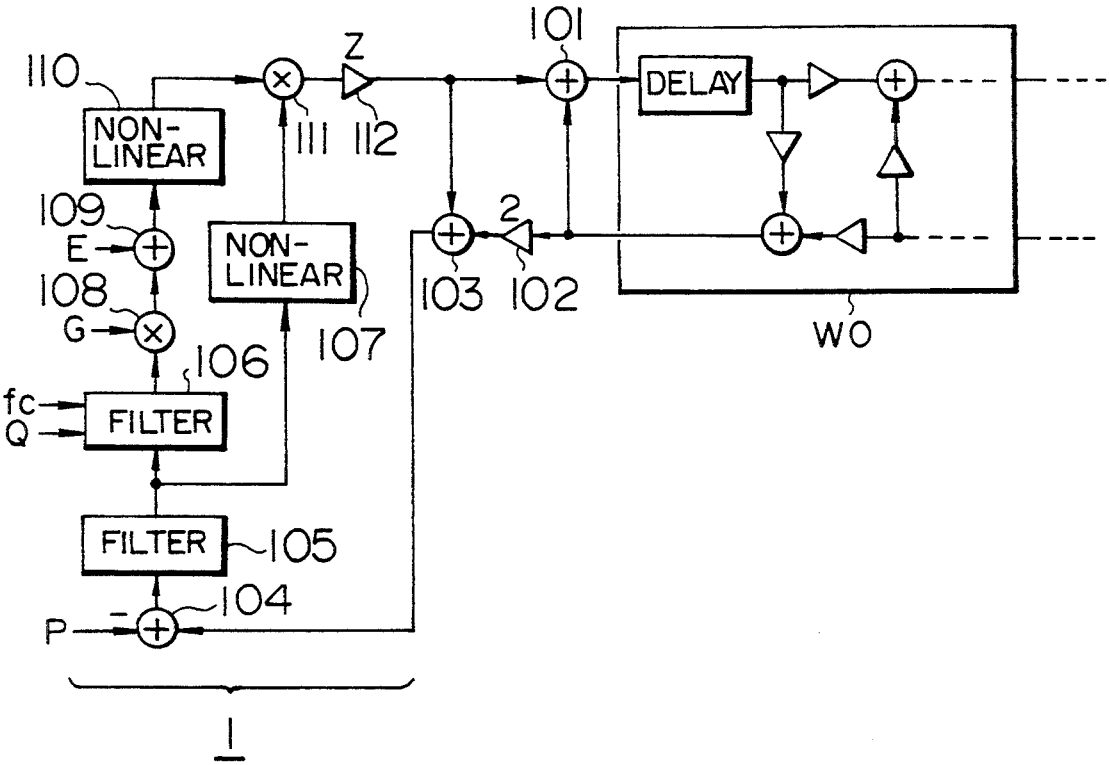
FIG. 11 is a block diagram showing a configuration of the exciting circuit to be used in the structure of FIG. 10.

Now, the configuration of the exciting circuit 1 will be described with reference to FIG. 11. The exciting circuit 1 comprises non-linear circuits 107 and 110, filters 105 and 106, a subtracter 104, adders 103 and 109, multipliers 108,111 and 112. The signal from the waveguide W0 is fed to one of the inputs of the adder 101, and also to one of the inputs of the adder 103 through the multiplier 102 where the signal is doubled. The output of the adder 103, which is a signal corresponding to air vibration to be fed-back to the reed in the mouthpiece of the wind instrument, is inputted to the subtracter 104. The signal P corresponding to the blowing pressure by the performer is subtracted in the subtracter 104 from the output of the adder 103.

The output of the subtracter 104, which is a signal corresponding to the pressure in the mouthpiece is fed to the phase correcting filter 105, in which high frequency components in the signal are damped. The output of the filter 105 is inputted to the filter 106, which is usually constituted of a low-pass filter and simulates response characteristics of the reed responsive to pressure changes in the mouthpiece. The output of the filter 105 is also fed to the non-linear circuit 107 which simulates saturation characteristics of the flow rate of the air-flow in the mouthpiece with respect to the air pressure in the mouthpiece. The filter 106 is controlled by the control circuit 3 as shown in FIG. 1 to change the cut-off frequency fc and selectivity Q thereof.

The output of the filter 106 is multiplied in the multiplier 108 by a gain G, and then is fed to the adder 109, in which an embouchure signal E corresponding to the force applied to the mouthpiece by a performer is added to the output of the multiplier 108. The output of the adder 109, which is a signal corresponding to the pressure applied to the reed, is fed to the non-linear circuit 110 simulating change of the cross-sectional area of the gap between the reed and the mouthpiece.

The outputs of both the non-linear circuits 107 and 110 are inputted to and multiplied by the multiplier 111, from which a signal is outputted corresponding to the volume flow rate of the air passing through the gap between the mouthpiece and the reed. The output of the multiplier 111 is further multiplied in the multiplier 112 by a value Z corresponding to the impedance against the air-flow in the mouthpiece. The output of the multiplier 112, which is a signal corresponding to pressure change occurring in the mouthpiece, is fed-back to the other input of the adder 103 and also transmitted to the wave-guide through the adder 101 where the above-mentioned output of the wave-guide W0 is added.

Now, an embodiment of a synthesizer for synthesizing a tone of a single-reed acoustic instrument will be described. The model for a single-reed acoustic instrument is constructed by reducing the delay time in the wave-guide corresponding to a mouthpiece to a very low value. The wave-guide comprises, in place of wave-guide W0 partly shown in FIG. 11, dual-direction transmission circuit W0 comprising 1 sampling period delay circuit 200 inserted in one of the parallel lines. The configuration of the waveguides W1 and W2 are the same as those in FIGS. 9 and 10.

The output $Z_f$ of the exciting circuit 1 is fed an adder 103 on one hand and to an adder 101 to be added with signal $q_1$ on the other hand. The output of the adder 101 is inputted to 1 sampling period delay circuit 200. The output of the 1 sampling period delay circuit 200 is inputted to a subtracter 24 as a subtrahend and also to a multiplier 21, in which the output is multiplied by $\alpha_i$. The output of the multiplier 21 is inputted to an adder 27, the output $q_j$ of which in turn is fed to the wave-guides W1 and W2. The output $q_j$ is further fed to the subtracter 24 as a minuend. The output of of the subtracter 24 is in turn fed to the other input of the adder 101 and to the multiplier 102. The output $q_i$, doubled in the multipler 102, is fed to the adder 103, which feeds back the output to the exciting circuit 1. Since the loop circuit includes 1 sampling period delay circuit 200, the transmission circuit Wo' will not act as a delay-free loop.

Figure 12:
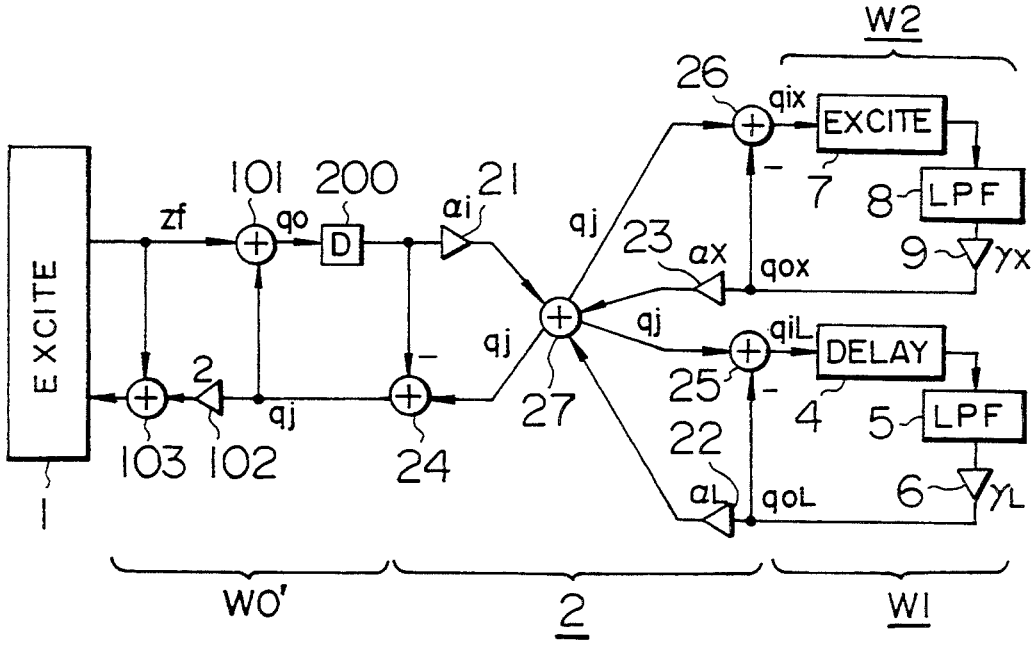
FIG. 12 is a block diagram showing a configuration of a single reed musical instrument according to an embodiment of the invention.
Figure 13:
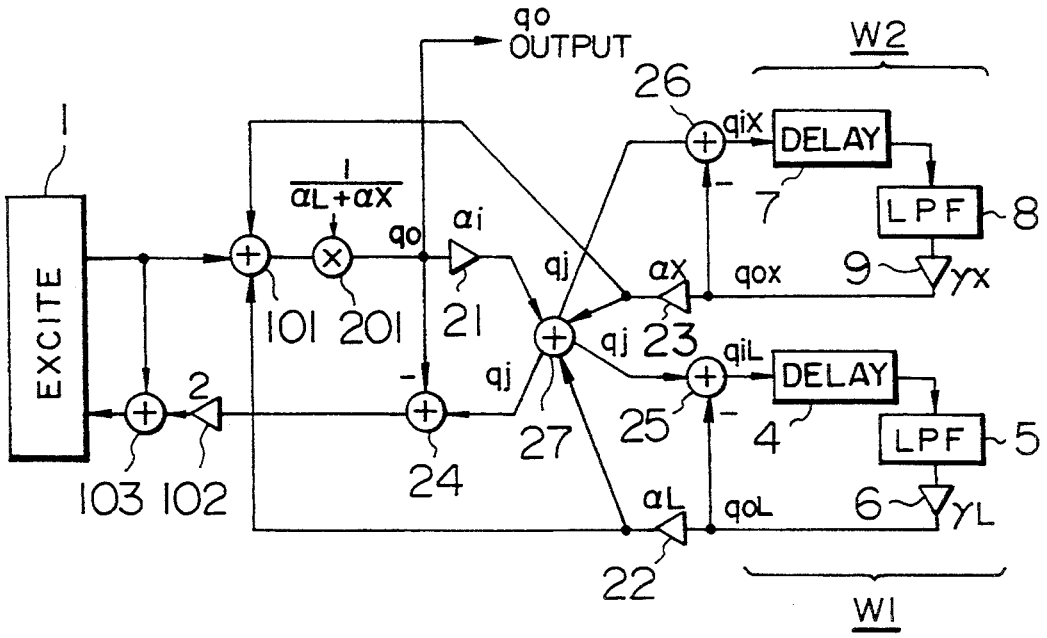
FIG. 13 is a block diagram showing a configuration of a single reed musical instrument according to another embodiment of the invention.

In order to faithfully simulate behavior of the single-reed acoustic instrument, however, it is desirable that 1 sampling period delay circuit 200 is not included, and yet that the delay -free loop is avoided in the circuit. FIG. 13 shows such an embodiment in which i sampling period delay circuit 200 is omitted from the circuit shown in FIG. 12. In FIG. 13, there is shown an embodiment of a tone synthesizer in which, in place of feed-back of the output of the subtracter 24 to the adder 101, the outputs of the multipliers 22 and 23 are fed to the adder 101. A multiplier 201 having a multiplication factor $1/(\alpha_X+\alpha_L)$ is disposed between the adder 101 and the multiplier 21.

The embodiment shown in FIG. 13 does not comprise a delay loop, but operates, as described hereinafter, equivalently to a circuit in which 1 sampling period delay loop 200 is omitted from the embodiment shown in FIG. 12. If it is assumed that there is not provided 1 sampling period delay loop 200 in FIG. 12 and that $Z_f$, $q_o$, $q_{iL}$, $q_{oL}$, $q_{iX}$ and $q_{oX}$ represent the output of the exciting circuit 1, the output of the adder 101, the outputs of the subtracters 24, 25, the output of the multiplier 6, the output of the subtracter 26, and the output of the multiplier 9, respectively. Then, the following equations hold.

$$q_i=q_{oL}+q_{oX}\alpha_X+q_o\alpha_X \tag{14}$$

$$q_i=q_j-q_o \tag{15}$$

$$q_{iL}=q_j-q_{oL} \tag{16}$$

$$q_{iX}=q_j-q_{oX} \tag{17}$$

and $$q_o=q_i+Z_f \tag{18}$$

When above equations (14), (15) and (18) are solved for the output $q_o$ of the synthesizer, $$\begin{aligned} q_o &= (q_{oL}\alpha_L + q_{ox}\alpha_x + Z_f)/(2-\alpha_i) \\ &= (q_{oL}\alpha_L + q_{ox}\alpha_x + Z_f)/(\alpha_L + \alpha_x) \end{aligned} \tag{19}$$

The signal having the same value as $q_o$ provided by the equation (19) is, therefore, generated as the output of the synthesizer. Consequently, the circuit of FIG. 13 operates equivalently to the circuit in which 1 sampling period delay circuit 200 is omitted from the circuit of FIG. 12.

Figure 14:
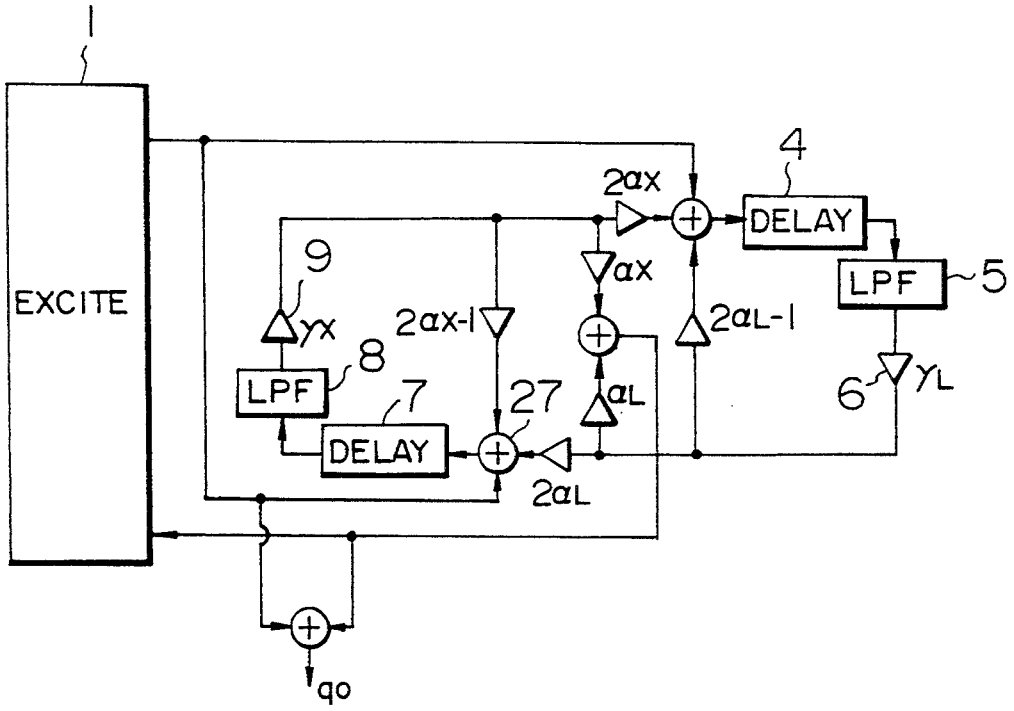
FIG. 14 is a block diagram showing a configuration of a single reed musical instrument according to still another embodiment of the invention.
Figure 15:
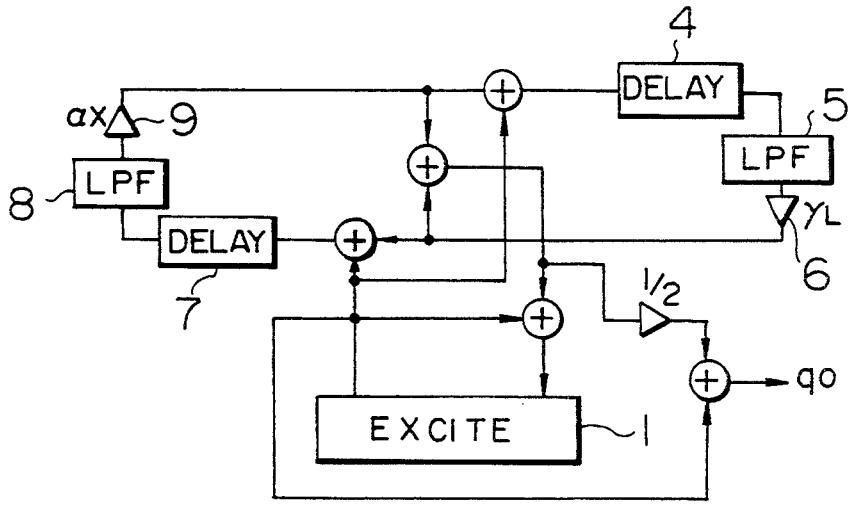
FIG. 15 is a block diagram showing a configuration of a single reed musical instrument according to still another embodiment of the invention.

If it is possible to assume that the multiplication factor $\alpha_i$ of the multiplier 21 is equal to 1, then a tone synthesizer shown in FIG. 14 can be obtained by simplifying the tone synthesizer in FIG. 13. Further, if it is possible to assume that multiplication factor $\alpha_i$ of the multiplier 21 is equal to 1 and the multiplication factor of the multipliers 22 and 23 are the same, i.e. $\alpha_L=\alpha_x$ exists, the circuit of FIG. 13 can be replaced by a simple circuit shown in FIG. 15.

In FIGS. 10 to 15, at least one of the exciting circuit 1, wave-guides W1, W2, W0, W0' and the junction 2 may be replaced by a DSP equivalently operating the corresponding electronic circuit functions by executing certain programs.

Figure 16:
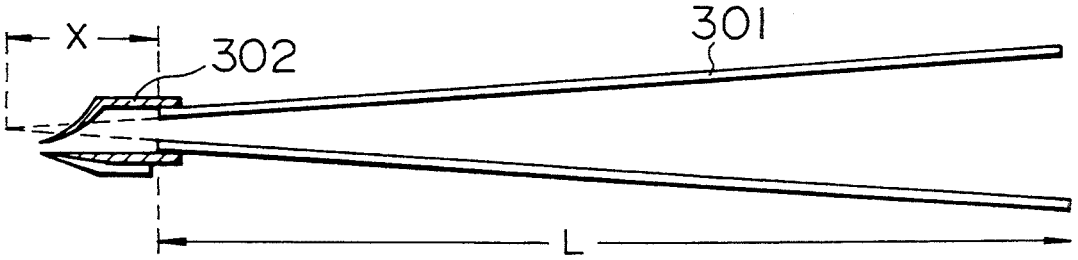
FIG. 16 is a longitudinal sectional view of a wind instrument with a conical tube to be simulated by a wind instrument according to an embodiment of the invention.

The embodiments described above relate to tone synthesizers synthesizing musical tones by way of electronic circuits or a digital signal processor executing certain programs. The present invention, however, is not limited only to such tone synthesizers, but covers acoustic wind instruments obtained by transforming conventional acoustic wind instruments based on the principle of the invention. FIGS. 17 to 22 show embodiments of acoustic wind instruments according to the invention. These wind instruments are devised by applying the above-mentioned analysis for transforming an acoustic wind instrument such as shown in FIG. 16 comprising a conical tube 301 and a mouthpiece 302 attached to a small diameter end of the conical tube.

Figure 17:
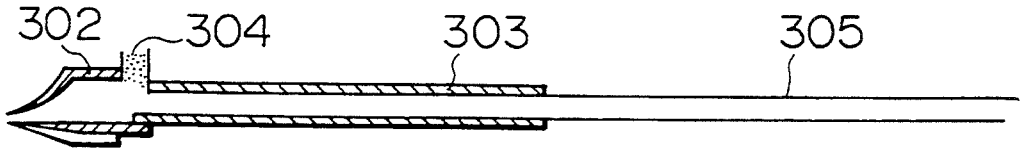
FIGS. 17 to 22 each shows a longitudinal sectional view of a wind instrument according to embodiments of the invention.

A wind instrument according to an embodiment of the invention shown in FIG. 17 comprises a mouthpiece element or mouthpiece member 302, a tube member 303 mounting at one end thereof an inertance element or inertance member 304 adjacent to the mouthpiece element 302, and a cylindrical slide-tube 305 slidably telescoped into the other end of the tube member 303. The inertance element 304 has inertance M as explained with reference to FIG. 6. The inertial mass m of the inertance element is obtained as $m=\alpha \cdot S \cdot X$, when assumed that $\rho(g/cm^3)$, $S(cm^2)$, and X (cm) represent medium density, cross-sectional area of the conical tube at the end of minimum diameter, and the length of the throat respectively. This embodiment of the wind instrument can generate a musical tone equivalent to the musical tone generated by a wind instrument with a conical tube shown in FIG. 16. Besides, it is possible to change tone pitch smoothly by changing the total length of the tubes 303 and 308.

It is possible to form both the mouthpiece element 302 and the inertance element 304 in a unitary body with the tube member 303, or to form a mouthpiece member 302 and a inertance member 304 separately from the tube member 303. In latter case, the inertance member 304 can be attached to either the mouthpiece member 302 or the tube member 303.

Figure 18:
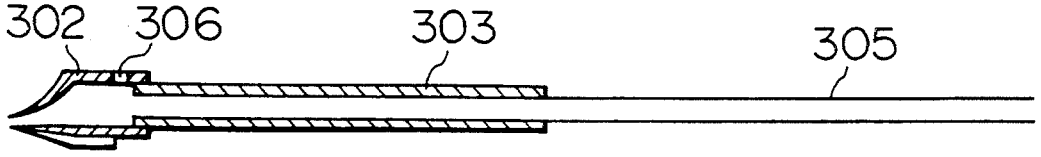

A wind instrument shown in FIG. 18 according to another embodiment of the invention is formed with, in place of the inertance element 304, a hole at the mouthpiece member 302 near the junction between the mouthpiece member 302 and the tube member 303, the hole 306 having an opening area S1 and a height X1. Values S1 and X1 are so determined that they satisfy the equation $S1/S=X1/X$. In this embodiment, a function similar to that of the embodiment in FIG. 17 can be obtained. Further, it is possible to adopt a hole 306 with a large diameter and to partly close the hole 306 with a finger during performance. In this case, tone pitch can be changed with the change of the area of the effective opening of the hole 306. The configuration and the role of the slide-tube 305 are the same as the ones in FIG. 17.

Figure 19:
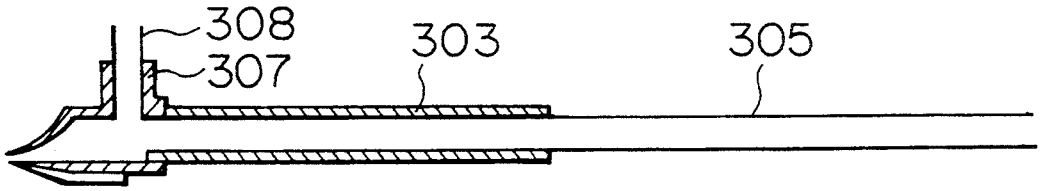

A wind instrument shown in FIG. 19 according to still another embodiment of the invention comprises a cylindrical boss 307 connected to the mouthpiece member 302 in FIG. 18 and another slide-tube 308 slidably telescoped into the boss 307. This embodiment can generate change of tone pitch similar to that obtained by changing the throat length X of the conical tube.

Figure 20:
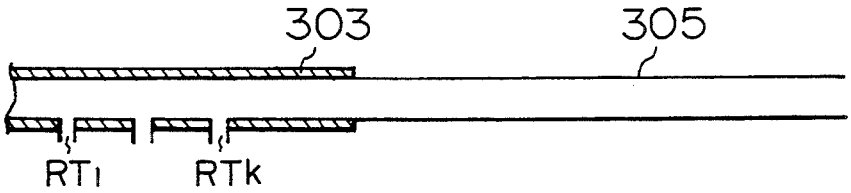

A wind instrument shown in FIG. 20 according to still another embodiment of the invention comprises in addition to the constituent elements of the instrument as shown in FIGS. 17 to 19, a plurality of holes at the tube member 303, to which register tubes (air-tubes) RT1~RTk are connected for selecting resonance mode. In this embodiment, those portions not shown in the drawing are similar to the corresponding parts of the embodiments shown in FIGS. 17 to 19. The register tube RT1 disposed near the mouthpiece element is related to high pitch tone and the register tube RTk disposed far from the mouthpiece element is related to low pitch tone. In this embodiment, operation of closing or opening the register tubes RT1~RTk enables to change resonance mode which otherwise would be determined by the effective length of the tube member 303 and the slide-tube 305, so that the tone pitch range can be widened during performance.

Figure 21:
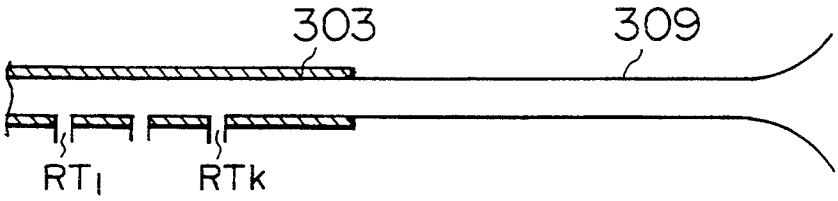

A wind instrument shown in FIG. 21 according to still another embodiment of the invention employs, in place of the slide-tube 305 of above embodiments shown in FIGS. 17 to 20, another slide-tube 309, the open end of which is divergingly tapered. With this embodiment, the emission characteristics of the tone can be improved.

Figure 22:
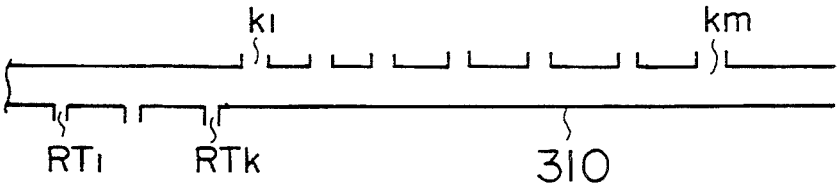

The last embodiment of the wind instrument shown in FIG. 22 employs, in place of the tube member 303 and the slide tube 305 in the embodiments shown in FIGS. 17 to 19, a cylindrical tube 310 formed with register tubes RT1~RTk and a plurality of another air holes called as tone holes k1~km formed thereon.

Although each of wind instruments and tone synthesizers described above can be constructed to generate a tone similar to the tone generated by a conventional wind instrument with a conical tube, the present invention is not limited to only such configuration. It is possible to construct a wind instrument or a tone synthesizer for generating an entirely new musical tone by way of free selection of the length of the cylindrical tube, inertance of the inertance elements or each of the parameters.

Since above embodiments are described only for examples, the present invention is not limited only to such embodiments and it will be obvious for those skilled in the art that various modifications or alterations can be easily made based on the above embodiments under the scope of the invention.

What is claimed is:

1. A tone signal synthesizer simulating characteristics of a conical resonance tube, comprising:

first bidirectional transmission means for receiving and reflecting a first electrical signal, having a first input, a first output, and a first delay element for producing a first delay time connected between said first input and said first output;

second bidirectional transmission means for receiving and reflecting a second electrical signal, having a second input, a second output, and a second delay element for producing a second delay time connected between said second input and said second output;

wherein the sum of said first and second delay times corresponds to the pitch of a tone to be generated;

pitch information generating means for generating pitch information which designates a tone pitch of a musical tone to be synthesized, said pitch information controlling at least one of said first and second delay elements;

exciting means for generating an exciting electrical signal, said exciting means having filter means for filtering a signal input thereto and non-linear means for imparting non-linear output characteristics to a signal input thereto, said filter means and said non-linear means being coupled in series;

control means for generating control signals in response to characteristics of the conical resonance tube to be simulated; and junction means, coupling said first and second transmission means and said exciting means in such a manner that said first and second transmission means are connected in parallel with respect to said exciting means, for combining signals supplied therefrom and inputting the combined signals thereinto in accordance with the control signals, whereby the synthesizer generates a tone signal simulating a conical resonance tube based on said control signals.

2. A tone signal synthesizer according to claim 1, wherein said junction means includes means for combining input signals and outputting combined outputs and interface means for connecting and adjusting signal transfer between the combining means and respective ones of said first and second transmission means and said exciting means.

3. A tone signal synthesizer according to claim 1, wherein said first bidirectional transmission means further includes a first reflection multiplier for multiplying a first reflection coefficient to said first electrical signal, and said second bidirectional transmission means further includes a second reflection multiplier for multiplying a second reflection coefficient to said second electrical signal.

4. A tone signal synthesizer according to claim 3, wherein said first delay element is a shift register having a variable number of stages controlled by said control means and said second delay element is a shift register having a fixed number of stages which is smaller than said variable number of stages.

5. A tone signal synthesizer according to claim 1, further comprising a third bidirectional transmission means for transmitting an electrical signal in both directions, connected between said exciting means and said junction means.

6. A tone signal synthesizer according to claim 5, wherein said third bidirectional transmission means includes lattice shaped junctions.

7. A tone signal synthesizer according to claim 1, wherein said junction means includes a first multiplier for multiplying a first multiplication factor to an output of said first bidirectional transmission means and a second multiplier for multiplying a second multiplication factor to an output of said second bidirectional transmission means.

8. A tone signal synthesizer according to claim 7, wherein said junction means further includes a third multiplier for multiplying a third multiplication factor to an output of said exciting means.

9. A tone signal synthesizer according to claim 7, wherein said junction means further includes a first signal path short-circuiting the input and the output of said first bidirectional transmission means and a second signal path for short-circuiting the input and the output of said second bidirectional transmission means.

10. A tone signal synthesizer according to claim 9, wherein said first transmission means includes a first low pass filter and second transmission means includes a second low pass filter.

11. A tone signal synthesizer according to claim 1, wherein said exciting means includes a filter having a cut-off frequency and a selectivity, and means for receiving an input signal expressing a pressure and giving predetermined characteristics to the input signal to simulate response characteristics of a reed.

12. A tone signal synthesizer according to claim 11, wherein said exciting means further includes an adder for adding an embouchure signal to the input signal.

13. A tone signal synthesizer according to claim 11, wherein said exciting means further includes a first non-linear circuit for affording a non-linear input-output characteristic to an output from said filter.

14. A tone signal synthesizer according to claim 13, wherein said exciting means further includes a second non-linear circuit for receiving the input and affording a second non-linear saturating input-output characteristic thereto, and a fourth multiplier for multiplying the output of said first and second non-linear circuits.

15. A tone signal synthesizer simulating a tone generation mechanism of a wind instrument having a conical resonance tube by approximating the conical resonance tube with two cylindrical resonance tubes, the synthesizer comprising:

first bidirectional transmission means, simulating one of the two cylindrical resonance tubes, for receiving and reflecting a first electrical signal, having a first input, a first output, and a first delay element connected between said first input and said first output;

second bidirectional transmission means, simulating the other of the two cylindrical resonance tubes, for receiving and reflecting a second electrical signal, having a second input, a second output, and a second delay element connected between said second input and said second output;

exciting means, simulating a mouthpiece of the wind instrument for generating an exciting electrical signal;

control means, for generating control signals which control the first and second transmission means and said exciting means; and junction means, directly coupled to each of said first and second bidirectional transmission means and said exciting means, for combining signals supplied therefrom and inputting the combined signals thereinto in accordance with the control signals so that the first and second bidirectional transmission means simulate the two cylindrical resonance tubes corresponding to the conical resonance tube, wherein the sum of the first and second delay times of the first and second transmission means corresponds to a pitch of a tone to be generated.

16. A tone signal synthesizer according to claim 15, wherein said first bidirectional transmission means further includes a first reflection multiplier for multiplying a first reflection coefficient to said first electrical signal and said second bidirectional transmission means further includes a second reflection multiplier for multiplying a second reflection coefficient to said second electrical signal.

17. A tone signal synthesizer simulating characteristics of a conical resonance tube, comprising:

first bidirectional transmission means for receiving and reflecting a first electrical signal, having a first input, a first output, and a first delay element for producing a first delay time connected between said first input and said first output;

second bidirectional transmission means for receiving and reflecting a second electrical signal, having a second input, a second output, and a second delay element for producing a second delay time connected between said second input and said second output;

wherein the first delay time is adjusted in response to a pitch of a tone to be generated and the second delay time is maintained constant such that the sum of said first and second delay times corresponds to the pitch of a tone to be generated;

pitch information generating means for generating pitch information which designates a tone pitch of a musical tone to be synthesized, said pitch information controlling said first delay element;

exciting means for generating an exciting electrical signal;

control means for generating control signals in response to characteristics of the conical resonance tube to be simulated; and junction means, coupling said first and second transmission means and said exciting means in such a manner that said first and second transmission means are connected in parallel with respect to said exciting means, for combining signals supplied therefrom and inputting the combined signals thereinto in accordance with the control signals, whereby the synthesizer generates a tone signal simulating a conical resonance tube based on said control signals.

18. A tone signal synthesizer comprising:

first bidirectional transmission means for receiving and reflecting a first electrical signal, having a first input, a first output, and a first delay element for producing a first delay time connected between said first input and said first output;

second bidirectional transmission means for receiving and reflecting a second electrical signal, having a second input, a second output, and a second delay element for producing a second delay time connected between said second input and said second output;

wherein the sum of said first and second delay times corresponds to a pitch of a tone to be generated;

pitch information generating means for generating pitch information which designates a tone pitch of a musical tone to be synthesized, said pitch information controlling at least one of said first and second delay elements;

exciting means for generating an exciting electrical signal;

control means for generating control signals in response to a tone color of musical tone to be synthesized; and junction means, directly coupling each of said first and second bidirectional transmission means and said exciting means such that said first and second bidirectional transmission means are connected in parallel with respect to said exciting means, for combining signals supplied therefrom and inputting the combined signals thereinto in accordance with the control signals, said junction means including a first multiplier for multiplying an output of said first bidirectional transmission means by a first multiplication factor, a second multiplier for multiplying an output of said second bidirectional transmission means by a second multiplication factor, and a third multiplier for multiplying an output of said exciting means by a third multiplication factor.

19. A tone signal synthesizer according to claim 18, wherein said first and second bidirectional transmission means are controlled by said junction means in accordance with said control signals to simulate a conical resonance tube, and wherein the first, second and third multiplication factors are selected in accordance with said conical resonance tube to be simulated.

* * * * *